United States Patent [19]

Pfarrwaller

[11] 3,973,599

[45] Aug. 10, 1976

[54] LOOM HAVING A CLOTH TAKE-UP SYSTEM

[75] Inventor: Erwin Pfarrwaller, Winterthur, Switzerland

[73] Assignee: Sulzer Brothers Limited, Winterthur, Switzerland

[22] Filed: May 19, 1975

[21] Appl. No.: 578,802

[30] Foreign Application Priority Data

May 24, 1974 Switzerland ..... 7093/74

[52] U.S. Cl. ..... 139/304; 139/307

[51] Int. Cl.[2] ..... D03D 49/20

[58] Field of Search ..... 139/304–311, 139/25–27; 66/149

[56] References Cited

UNITED STATES PATENTS

| | | | |
|---|---|---|---|
| 2,226,090 | 12/1940 | Burdett | 139/304 |
| 3,428,095 | 2/1969 | Pfarrwaller | 139/304 |
| 3,612,109 | 10/1971 | Pfarrwaller | 139/304 x |
| 3,620,262 | 11/1971 | Atkinson | 139/307 |
| 3,698,446 | 10/1972 | Miller et al. | 139/308 |
| 3,703,914 | 11/1972 | Freisler | 139/308 |
| 3,710,829 | 1/1973 | Johnson et al. | 139/304 |

*Primary Examiner*—James Kee Chi

*Attorney, Agent, or Firm*—Kenyon & Kenyon Reilly Carr & Chapin

[57] ABSTRACT

The cloth take-up system drives the deflecting roller over a friction clutch to allow slippage of the deflecting roller while the cloth moves over the deflecting roller without slip. The clutch is adjustable to create more or less of a relative slip.

7 Claims, 2 Drawing Figures

LOOM HAVING A CLOTH TAKE-UP SYSTEM

Figure 1:
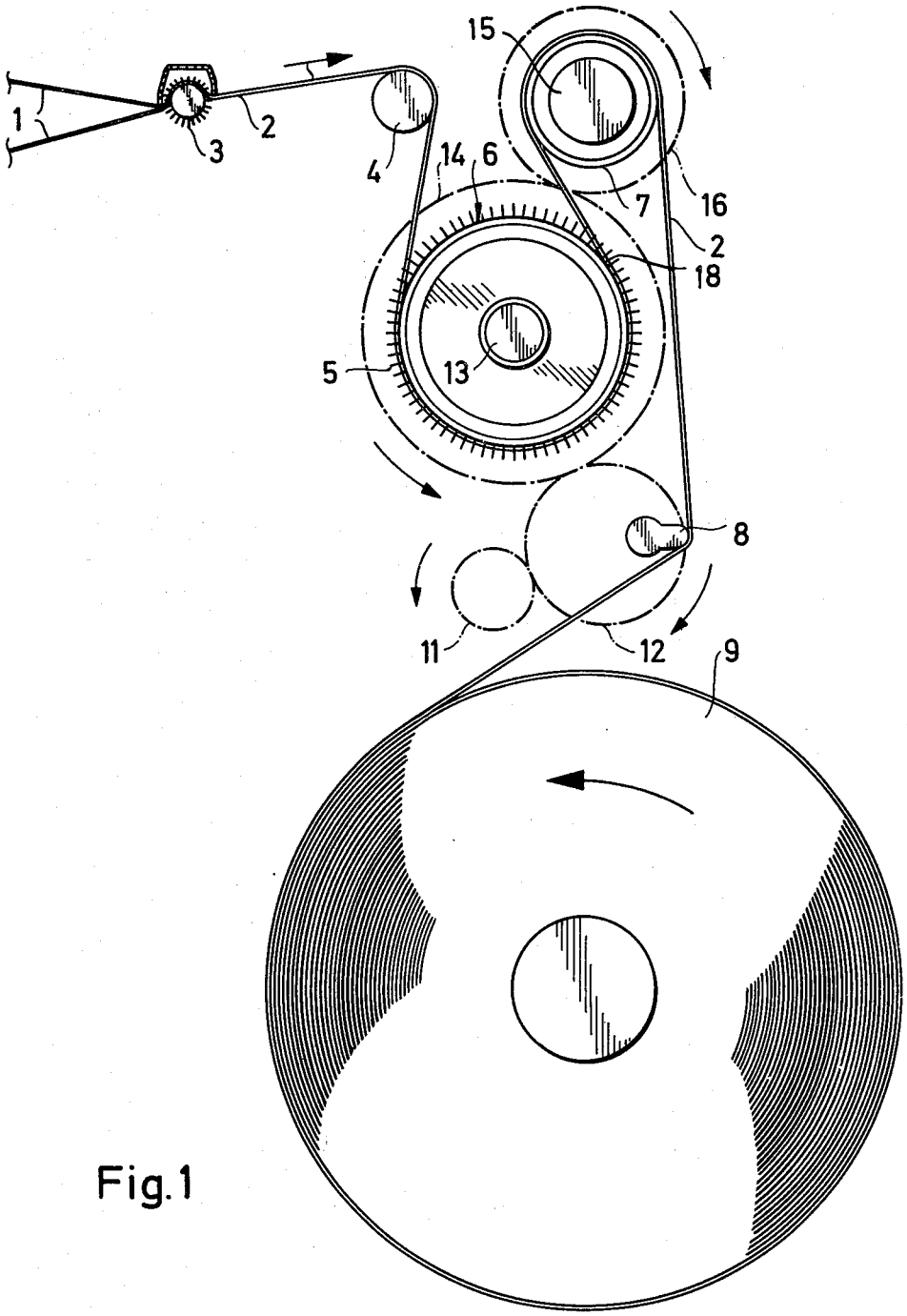

This invention relates to a loom having a cloth take-up system.

Heretofore, various types of looms for weaving, for example plain cloth and terry cloth, have been provided with cloth take-up systems in which the produced cloth is taken-up and then wound on a cloth roll. Generally, these take-up systems employ a cloth take-up roller, which may or may not have needles around the periphery, a deflecting roller following the take-up roller and a cloth beam. Usually, the deflecting roller is driven merely by the movement of the cloth passing over the roller and does not have an independent drive while the cloth beam is driven by way of a slipping clutch. However, in these instances, the fabric may, for some reason, fail to be removed from the take-up roller with sufficient uniformity. For instance, the cloth beam and/or the deflecting roller may be stopped temporarily by external factors, such as the machine operators, with the result that the cloth may remain in engagement with the take-up roller over a larger angle of wrap than normal. This raises the possibility of interrupted operation.

Accordingly, it is an object of the invention to insure a uniform take-up of cloth produced in a loom.

It is another object of the invention to avoid snarling of the cloth produced in a loom during take-up.

It is another object of the invention to avoid accidental stops of the deflecting roller of a cloth take-up system of a loom by external forces.

Briefly, the invention provides a cloth take-up system for a loom which includes a cloth take-up roller for receiving a travelling length of cloth, a deflecting roller spaced from the take-up roller downstream of the take-up roller for passage of the cloth thereover and a transmission coupled to the rollers. The transmission includes a friction clutch having two halves which engage with the deflecting roller to permit slipping of the deflecting roller relative to the transmission under the friction force of the cloth on the deflecting roller. The transmission also drives the rollers at a transmission ratio in which the deflecting roller has a greater peripheral speed than the take-up roller. For example, in the absence of the cloth the transmission would drive the deflecting roller at a peripheral speed about five percent (5%) faster than the peripheral speed of the take-up roller.

The invention is particularly valuable in cases in which the cloth take-up roller has needles around its periphery for a terry fabric — i.e. in the case of a terry loom. In this case, the cloth is removed uniformly and reliably from the take-up roller needles, thus obviating the risk that the operation may become disturbed by entangling of the cloth. Also, the deflecting roller cannot be readily stopped accidentally by external factors.

It has already been suggested to have the deflecting roller driven faster than the take-up roller. According to the invention, however, in contrast to such a suggestion the cloth moves over the deflecting roller without slip and the friction clutch always slips slightly. All that is needed to bring about this state of affairs is to ensure that the friction between the two halves of the clutch is less than the friction between the cloth and the deflecting roller. The cloth is then treated very gently. Also, it becomes possible for the cloth to be removed from the take-up roller at a constant predetermined force, thus obviating disturbances, in the movement of the cloth so far as the take-up roller is concerned.

Figure 2:
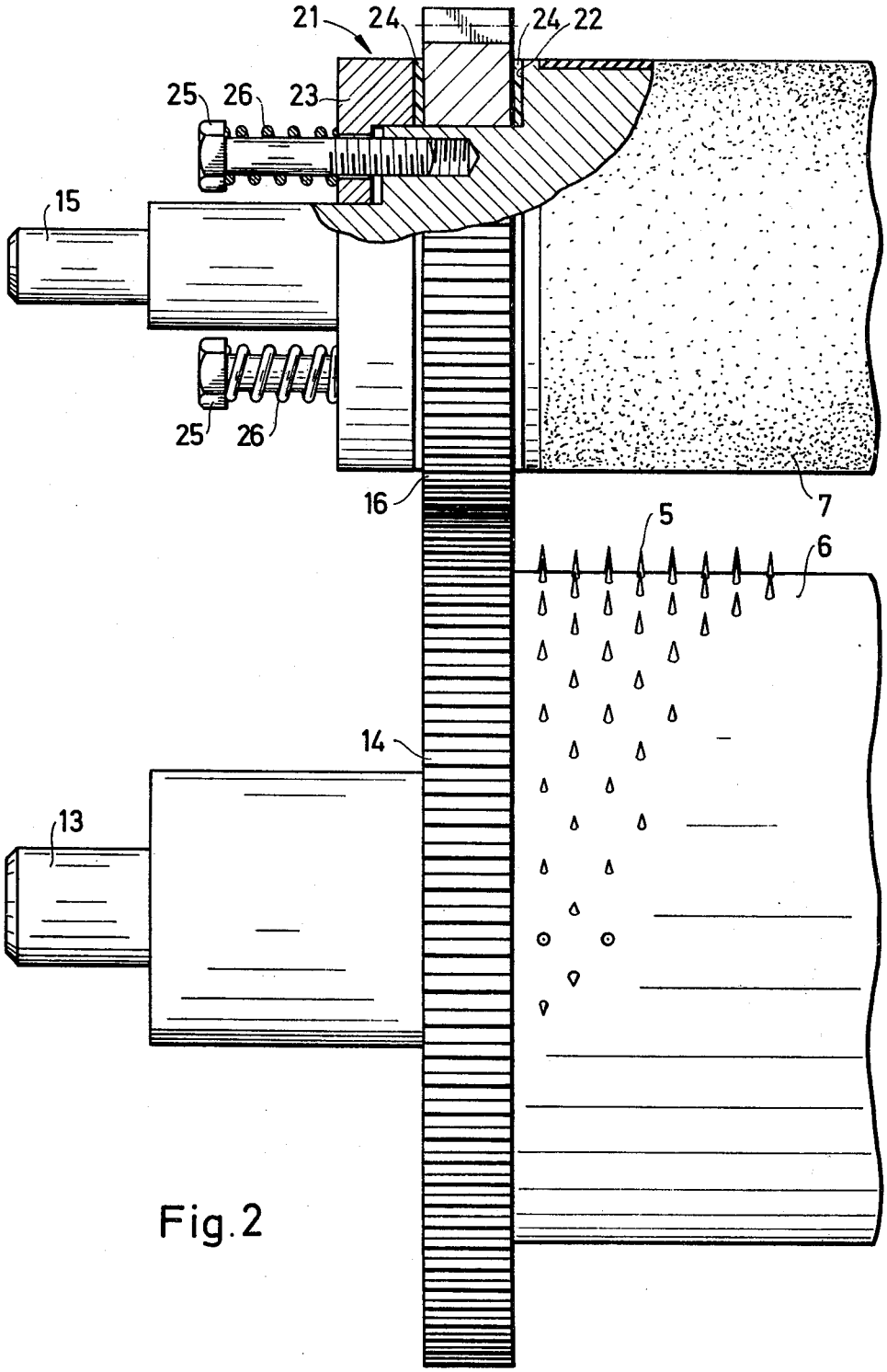

These and other objects and advantages of the invention will become more apparent from the following detailed description and appended claims taken in conjunction with the accompanying drawings in which:

FIG. 1 diagrammatically illustrates a vertical sectional view of the cloth end of a weaving machine according to the invention; and FIG. 2 illustrates a corresponding front elevational view looking on to a part of the weaving machine from the cloth end but to an enlarged scale and with the cloth omitted.

Referring to the drawing, the loom which forms a shed 1 for producing a cloth 2 includes a temple 3 through which the cloth 1 passes to a take-up system. This take-up system includes an undriven deflecting roller 4, a take-up roller 6 which has needles 5 around the periphery when the cloth 2 is a looped or terry fabric, a driven deflecting roller 7 for passage of the cloth therearound, a deflecting bar 8 and a cloth beam 9 downstream of the deflecting roller 7 and bar 8 for winding up the cloth 2. The beam 9 isdriven by a slip-clutch (not shown).

In addition, the take-up system includes a transmission in the form of a gearing coupled to the take-up roller 6 and deflecting roller 7 for driving these rollers 6, 7 at a transmission ratio in which the deflecting roller 7 has a greater peripheral speed than the take-up roller 6. This transmission includes a drive gear 11 which meshes with a gear 12 which is in engagement with a gear 14 secured to a drive shaft 13 of the take-up roller 6. The gear 14, in turn, drives a gear 16 which forms one half of a friction clutch 21 mounted about a drive shaft 15 of the deflecting roller 7. The other half of the clutch 21 is formed by a shoulder 22 of the deflecting roller 7 and by a ring 23 which is secured by screws 25 to the deflecting roller 7 and which can be tightened against the force of springs 26. The gear 16 carries two friction linings 24, as shown, on opposite sides which respectively face the shoulder 22 and ring 23. In this way, the deflecting roller 7 is driven by gear 14 via gear 16 and clutch 21. The roller 7 has e.g. a rough rubber surface. In the particular example described, the various gears have the following number of teeth;

| | Number of Teeth |
|---|---|
| Gear 14 | 48 |
| Gear 16 | 28 |

The take-up roller 6 is 149 millimeters (mm) in diameter and the deflecting roller 7 is 91 millimeters (mm) in diameter. Thus, in the absence of the cloth 2 running over the rollers 6, 7, the peripheral speed of the deflecting roller 7 is about 5 percent more than that of the take-up roller 6.

When the cloth 2 moves over the rollers 6, 7 during operation, the friction clutch 21 can be so adjusted by means of the screws 25 that the cloth 2 moves over the periphery of the deflecting roller 7 without slip — i.e. the cloth 2 does not slide. Instead, however, the clutch 21 slips a little i.e. the gear 16 runs faster than the deflecting roller 7. The slip occurs between the friction linings 24 of the gear 16 and the respective shoulder 22 and ring 23. The cloth 2 is then removed, more particularly, at a place 18, cleanly and uniformly from the needles 5 of the take-up roller 6.

In a variant, the take-up roller has a very rough peiphery of corundum or the like instead of needles. In uch cases, the slipping clutch 21 allows the gear 16 to un faster than the deflecting roller 7 to ensure that the loth, more particularly a rough fabric e.g. of wool or ute, lifts or disengages uniformly from the corundum ake-up roller.

In another embodiment, the two rollers 6, 7 can be lriven intermittently, e.g. by way of a ratchet drive. In his case, and if the friction clutch 21 has been adjusted :orrectly by means of the screws 25, the average speed of gear 16 is greater than the average speed of the leflecting roller 7.

What is claimed is:

1. A loom having a cloth take-up system including a :loth take-up roller for receiving a travelling length of :loth, a deflecting roller spaced from said take-up oller downstream thereof for passage of the cloth herearound, a cloth beam downstream of said deflectng roller for winding up of the cloth thereon and a gearing coupling said take-up roller and said deflecting oller together for driving said take-up roller and delecting roller at a transmission ratio in which said delecting roller has a greater peripheral speed than said ake-up roller, said gearing including a friction clutch engaging said deflecting roller.

2. A loom as set forth in claim 1 which further ineludes means for adjusting the friction of said friction :lutch.

3. A loom as set forth in claim 1 wherein said friction :lutch includes a driven half and a driving half and said gearing includes a first gear for driving said take-up roller and a second gear mounted between said clutch halves for driving said deflecting roller and meshing with said first gear, each of said gears having teeth with the tooth number of said first gear relative to the tooth number of said second gear being sufficient to obtain a slip-free movement of the cloth on said deflecting roller.

4. In a cloth take-up system for a loom, the combination of a cloth take-up roller for receiving a travelling length of cloth, a deflecting roller spaced from said take-up roller downstream thereof for passage of the cloth therearound, and a transmission coupled to said take-up roller and said deflecting roller for driving said take-up roller and deflecting roller at a transmission ratio in which said deflecting roller has a greater peripheral speed than said take-up roller, said transmission including a friction clutch engaging said deflecting roller to permit slipping of said deflecting roller relative to said transmission under the friction force of the cloth on said deflecting roller.

5. In a cloth take-up system for a loom as set forth in claim 4, said take-up roller having needles on the surface thereof.

6. In a cloth take-up system for a loom as set forth in claim 4 wherein said friction clutch is adjustable to vary the slip resistance thereof.

7. A loom as set forth in claim 1 wherein said cloth take-up roller has a plurality of projecting needles on the periphery thereof for receiving a travelling length of cloth.

* * * * *